US005299822A

United States Patent [19]

Mayr et al.

[11] Patent Number: 5,299,822

[45] Date of Patent: Apr. 5, 1994

[54] PLASTIC SHELL SKI

[75] Inventors: Bernhard Mayr, Hard; Lampl Heinz, Hohenems, both of Austria

[73] Assignee: Head Sport Aktiengesellschaft, Austria

[21] Appl. No.: 768,410

[22] PCT Filed: Feb. 11, 1991

[86] PCT No.: PCT/AT91/00025

§ 371 Date: Oct. 7, 1991

§ 102(e) Date: Oct. 7, 1991

[87] PCT Pub. No.: WO91/12057

PCT Pub. Date: Aug. 22, 1991

[30] Foreign Application Priority Data

Feb. 9, 1990 [AT] Austria ..... A295/90

[51] Int. Cl.[5] ..... A63C 5/14

[52] U.S. Cl. ..... 280/610; 280/602; 280/609

[58] Field of Search ..... 280/602, 607, 609, 610, 280/601, 603, 14.2, 28, 608

[56] References Cited

U.S. PATENT DOCUMENTS

| | | | |
|---|---|---|---|
| 2,695,178 | 11/1954 | Rheinfrank, Jr. | 280/610 |
| 3,374,001 | 3/1968 | Baudou | 280/610 |
| 3,493,240 | 2/1970 | Jenks | 280/610 |
| 3,614,116 | 10/1971 | Haldemann | 280/610 |
| 3,771,805 | 11/1973 | Ishida | 280/610 |
| 3,933,362 | 1/1976 | Sakuma et al. | 280/610 |
| 3,940,157 | 2/1976 | Sakuma | 280/610 |
| 4,199,169 | 4/1980 | Guenzel et al. | 280/602 |
| 4,697,820 | 10/1987 | Hayashi et al. | 280/610 X |
| 4,911,462 | 3/1990 | Diard et al. | 280/610 X |
| 4,928,989 | 5/1990 | Mayr et al. | 280/610 |

FOREIGN PATENT DOCUMENTS

| | | | |
|---|---|---|---|
| 145213 | 11/1935 | Austria | 280/610 |
| 286842 | 12/1970 | Austria . | |
| 296834 | 2/1972 | Austria . | |
| 389452 | 12/1989 | Austria . | |
| 390197 | 3/1990 | Austria . | |
| 309282 | 8/1993 | Austria . | |
| 734828 | 5/1966 | Canada | 280/610 |
| 917688 | 12/1972 | Canada | 280/610 |
| 0123635 | 10/1984 | European Pat. Off. | 280/602 |
| 2332909 | 1/1974 | Fed. Rep. of Germany | 280/610 |
| 3406056 | 8/1985 | Fed. Rep. of Germany . | |
| 3414440 | 10/1985 | Fed. Rep. of Germany | 280/610 |
| 71512 | 1/1960 | France | 280/610 |
| 1453516 | 9/1966 | France . | |
| 1473256 | 3/1967 | France | 280/610 |
| 2261027 | 9/1975 | France . | |
| 9003205 | 4/1990 | World Int. Prop. O. | 280/602 |

*Primary Examiner*—Brian Johnson

*Attorney, Agent, or Firm*—Nixon & Vanderhye

[57] ABSTRACT

In a plastic shell ski (1) with a body formed by hollow sections and a lower part with a running surface, and top (10) is connected to the lower part by substantially vertical webs (3, 5) running in the ski longitudinal direction, hollow sections (2, 4) are formed by at least two U sections open on the same side and variable in height, whose webs (3, 5) are connected to connecting sections (9), running in the longitudinal direction, for the connection with a substantially plate-shaped part (8) by welding and/or gluing.

16 Claims, 5 Drawing Sheets

PLASTIC SHELL SKI

TECHNICAL FIELD

The invention relates to a plastic shell ski with a body formed by hollow sections and a lower part with a running surface, and the top is connected with the lower part by basically vertical webs running in the ski longitudinal direction.

BACKGROUND PRIOR ART

A series of proposals has already been made for the design of plastic shell skis, in which consistently more or less costly forming steps were necessary for the individual components of the shell ski. For example, from AT-PS 309,282 it has already become known to assemble a plastic shell ski from an upper shell and a lower shell, and both shell parts exhibit webs projecting toward each other. Such webs were designed so that one web of one shell could be pressed in between two webs of the opposite shell and in this way could be inseparably joined to the opposite shell. Such a design requires that in the manufacture of the shell parts, a high degree of precision be maintained, and it must further be insured that the desired shape of the ski results. Moreover in these cases the assembly of such half shells is relatively costly. A shell design, once it is produced, can be reliably used only for one and the same type of ski with a certain length, and a later alteration of the height of the ski core is not easily possible, unless at the same time the danger of an inadequate connection of the two shell parts with one another is accepted.

According to the proposal in AT-PS 390,197 a shell ski was assembled from a number of sections, whose webs or legs perpendicular to the running surface, delimit hollow spaces, and according to this earlier proposal the bent sections are nested in one another, overlapping one another at least partially. The hollow spaces that are formed in this way between adjacent webs or legs can be subsequently filled with a filling material. In this design, as a result of the possible lateral shifting of the outer sections over the length of the ski relative to the inner section or sections, an easier matching to the desired outer contour of the ski seems possible. However, disadvantageous with such a design is the circumstance that because of the special design of the sections, at least in the lateral edge areas, a subsequent machining is not easily possible and furthermore, depending on the type of arrangement, the legs of the areas which are to be nested in one another have to be designed with dimensions reduced by the wall thickness of the section in the areas located between the legs, to produce an even outer contour. All these measures make any later precise machining difficult and thus here also for each ski norm the appropriate section must be prefabricated as precisely as possible.

Particularly with the use of fiber-reinforced plastics it is advantageous if sections that are as simple as possible are used and if the sections are produced in one simple production operation, for example by simple pressing, extrusion or pultrusion. Extrusion of fiber-reinforced sections is possible in principle, but can be used, however, only when there is a constant cross-section.

SUMMARY OF THE INVENTION

The object of this invention is to provide a shell ski of the initially mentioned type, in whose production only simple forming steps are required, so that any fiber orientations can be maintained with certainty and which makes it possible to use standard sections which can be subsequently machined at low cost (even for differing heights of the ski body) without any danger of an inadequate connection of the shell parts with one another. To achieve this object, the plastic shell ski of the initially mentioned type is further formed according to the invention so that the hollow sections are formed by at least two U sections open to the same side and variable in height, whose webs are joined with the connecting sections running in the longitudinal direction for the connection to one substantially plate-shaped part by welding and/or gluing. Since only U sections are used to start with it, is guaranteed that such sections can be produced in a simple forming process. Such U sections can be produced for example by compression molding, extrusion or pultrusion and such a process guarantees that the desired fiber orientation present in a fiber-reinforced material is not influenced by the forming process. Since the U sections are placed open toward the same side, every second shell part for the finishing of the shell ski is essentially identical, so that for even great quantities of the starting material, relatively little storage space is needed. In the design according to the invention the U sections can find multiple use in the same basic dimensions over the width of the ski, so that a uniform starting material can be more economically produced which can be used for different ski widths, since with this design it is sufficient to design one or two of the sections, for example the middle U sections, to fit the desired ski shaping. But the desired ski shaping can be achieved in a particularly simple manner with two U sections of the same type, if they are placed following the wide edges of the ski and if it is accepted that different lateral distances crosswise to the ski longitudinal direction are obtained between the inner webs over the length of the ski. In this case the ski is finished by applying a cover layer or a cover plate bridging the gap, for example, a laminate, which bridges the gap between the inner webs, and if necessary the gap or even the hollow spaces of the U sections can be packed with foamed material. Also by placing at least three of these U sections beside one another, of which the middle U section or sections exhibits/exhibit a corresponding narrowing in the area of the shaping, the same starting material can always be used for the two outer U sections. Since the U sections are placed so that their free legs or webs point in the same direction, it also possible to later adjust the desired height with ease, simply by removing material in the area of the leg. The U sections placed beside one another can thus be run over an appropriate milling device or the like, for example, so that the height desired in each case can be directly obtained. The finishing of the chambers, by closing the open U sections with a basically plate-shaped part, can be done by machine without costly adjustment steps, so that with efficient production of the intermediate material, i.e. the U sections, an efficient production of the plastic shell ski as a whole is also made possible. In the case of the use of at least one appropriately shaped U section placed between outer U sections, a closed cover layer is directly formed, which requires no additional cover layer. This closed cover layer can be varnished or the like, if desired. Further, ski toe parts designed with appropriate holding devices can be introduced into the chambers limited by the U sections, and according to a preferred further development, the design can be made so that the shovel and/or tail area is formed by end parts that can be positively inserted into the hollow sections.

Advantageously the design according to the invention is made so that the connecting sections exhibit a longitudinal groove, and the width of the connecting section is enlarged on the side facing away from the longitudinal groove, by which a simple assembly is made possible. In this case, the design can preferably be made so that the webs of the U sections placed in the inside area of the upper part rest against one another and are connected to the connecting sections of the plate-shaped part exhibiting a longitudinal groove, whose inside width corresponds to the thickness of the webs of two U sections adjacent to one another. For different ski designs it is thus only necessary to provide different plate-shaped parts with corresponding connecting sections, which in turn can be produced in simple forming steps and with constant outer U sections, it is only necessary to adjust the inner U section or sections to the desired width of the ski or to the desired shaping.

The connecting sections can be produced separately from the plate-shaped part, so that the expense for different forms is further reduced. Preferably in this case, the connecting sections are made of plastic or aluminum and are connected with the plate-shaped part by welding or gluing. Simple assembly is thus possible if, as it corresponds to a preferred embodiment, the plate-shaped part is designed as a separate component for closing the hollow sections and is connected to a lower part carrying the running surface and the edges. Alternatively, of course, a plate-shaped part can be used which already carries the running surface and the edges.

The intermediate products of the plastic shell ski, namely the individual U sections, can be stored in a space-saving manner and a particularly efficient design results, if the design is made so that the upper part consists of at least three U sections located next to one another, so that the outer U sections exhibit a constant width over their entire length and so that the inner section (sections) exhibits (exhibit) a varying width over its (their) length. Since the outer U sections each can be designed identically for different types of skis, the amount of different parts required for ski design is reduced to a minimum. The shaping of skis usually remains within limits which are within the elastic deformation limits of the outer U sections so that the assembly is in no way made more difficult.

In view of the possibility of designing the outer sections for different ski types in the same way and in the simplest way possible, the desired inclination of the side walls can also be directly predetermined by the outer sections, for which the design is preferably made so that the inclination of the webs of the outer U sections facing the side walls is designed according to the inclination of the side walls.

A smooth contour of the cover side can be especially easily obtained through appropriate shaping of the upper side of the U sections that are open downward. A tongue and groove connection thus leads to a mechanical improvement of a welded or glued connection, and preferably the design is made so that the U sections exhibit on their closed upper side that is facing away from the plate-shaped part side lugs and/or recesses, which engage positively with recesses or lugs of each of the adjacent U sections, or are connected in flush with the surface to cover plates or edge components connecting adjacent U sections. By using only two U sections that are open downward, the gap resulting from the shaping can be covered over by a correspondingly wide overhang of the side lug, so that here also a separate cover layer can be dispensed with and the processing of the contour of the side lug for designing the shaping is made possible by a simple milling process.

In this way a plastic shell ski body is directly formed out of an extremely small number of different individual parts, which can be processed into a finished ski merely by the placement of edges, running surfaces and optionally a decorative top layer. The section hollow spaces can be packed with foamed material to increase stability.

BEST MODE FOR CARRYING OUT THE INVENTION

Figure 1:
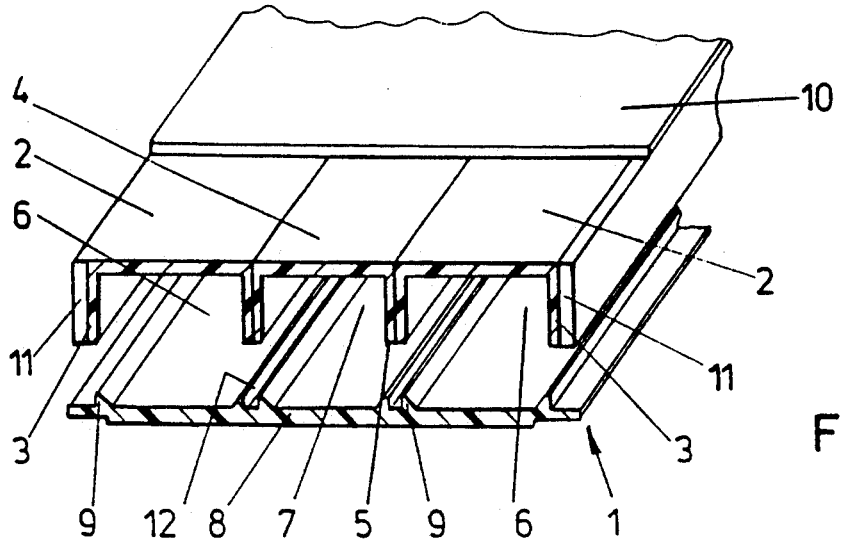
FIG. 1 shows a partially perspective top view of a plastic shell ski according to the invention, and for the sake of clarity the plate-shaped part is represented separate from the U sections.

In the plastic shell ski 1, represented in FIG. 1 the body or the overall height of the ski is formed by three hollow sections located next to one another in the form of U sections, and outer U sections 2 exhibit over their entire length a constant distance of their webs 3, while middle U section 4, corresponding to a varying width or shaping, exhibits a variable distance of its webs 5 over the length of the ski. Outer U sections 2 can thus be designed with a width of approximately 25 mm, for example, to obtain the generally desired width for a ski. The adjacent U sections limit respective chambers or hollow spaces 6 or 7 and each one is designed to be open to the same side. When ski 1 is assembled, webs 3 or 5 of U sections 2 and 4 are connected to plate-shaped part 8 which exhibits connecting sections 9 running in the longitudinal direction of the ski, and the connection of the body of the ski formed by the U sections to plate-shaped part 8 takes place by gluing or welding the webs in longitudinal grooves 12 of connecting sections 9. For finishing of the ski represented in FIG. 1, cover plate 10, which can optionally be merely a decorative plate, is secured on the ski body formed by the U sections, and the plate-shaped part is provided with a running surface and steel edges. Further, side walls are placed on outside webs 3 of outer sections 2. Connecting sections 9 of plate-shaped part 8 in this embodiment are designed as one piece with the plate-shaped part and webs 3 or 5, which are machined according the overall height of the ski body, sink basically perpendicularly into longitudinal grooves 12 on the base of plate-shaped part 8, to make possible an exact positioning of the webs. Inside width a of longitudinal grooves 12 of connecting sections 9 is thus adapted to the thickness of webs 3 or 5. Connecting sections 9 exhibit in cross section a triangular or trapezoidal cross section with longitudinal groove 12 in the area of the tip or the shorter parallel side, so that through the widening of the cross section of the connecting sections a good bearing and support surface on plate-shaped part 8 results.

Chambers 6 and 7 limited by the U sections can be filled with appropriate material to arrive at the desired ski characteristics and further it is possible to put different tips into chambers 6 and 7 limited by the webs, as this will be explained in greater detail below.

Figure 2:
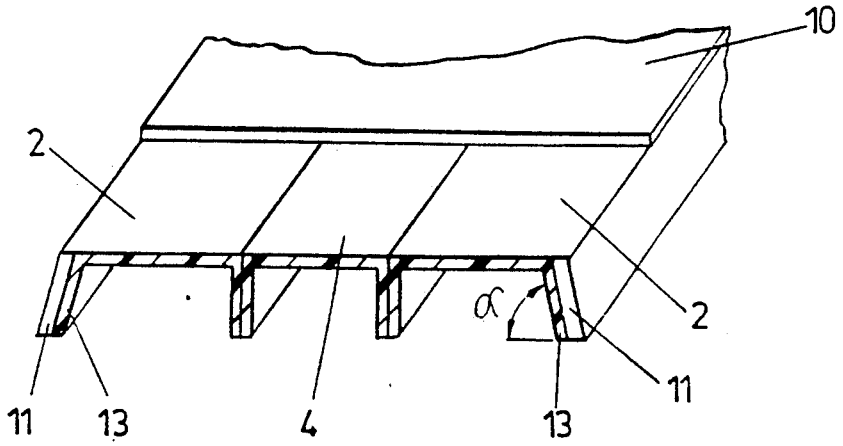
FIG. 2, in a representation analogous to FIG. 1, shows a modified embodiment of the U sections.

The embodiment represented in FIG. 2 basically differs from the design according to FIG. 1 only in that the inclination of webs 13 of outside U sections 2 that are facing side walls 11 enclose an angle deviating from a right angle with the base.

Figure 3:
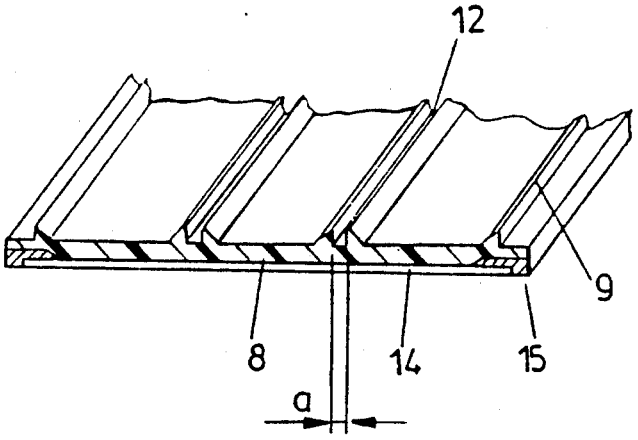
FIG. 3 shows a partially perspective top view of a modified embodiment of the plate-shaped part.

Plate-shaped part 8 represented in FIG. 3, with connecting sections 9 for fastening the webs of the U sections forming the body, is provided with running surface coating 14 and steel edge member 15, so that finishing the assembly of a ski with such a plate-shaped part is simplified. Longitudinal grooves 12 (having an inside width dimension "a") are similar to those described above in conjunction with FIG. 1.

Figure 4:
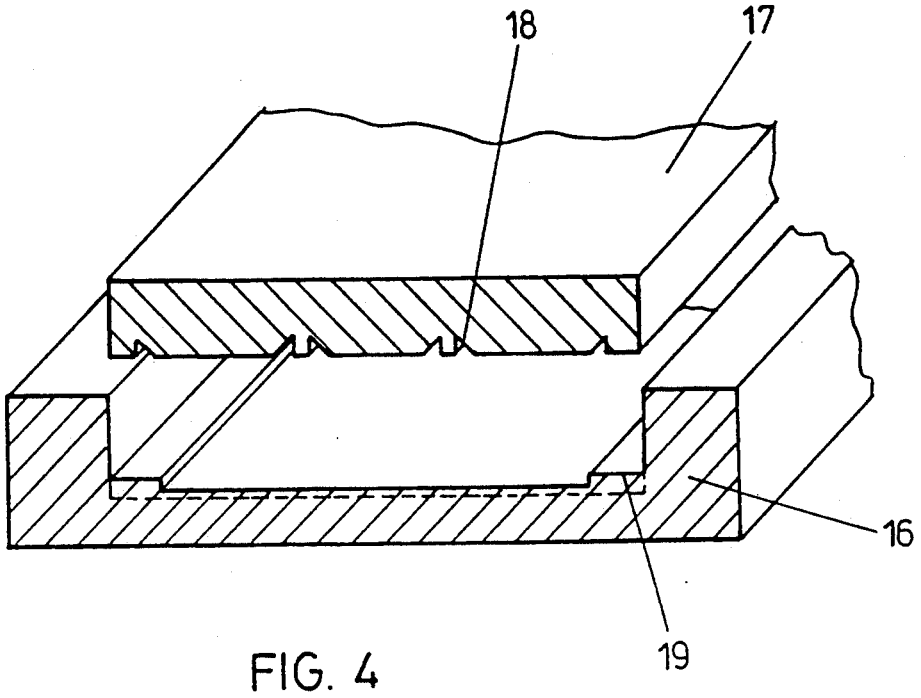
FIG. 4 shows a partially perspective top view of molded parts for the production of the plate-shaped part, and for the sake of clarity the individual molded parts are represented separate from one another.

Molded parts 16 and 17 for forming a plate-shaped part are represented in FIG. 4, and molded part 17 exhibits recesses 18 to produce connecting sections 9. The molded parts represented in FIG. 4 thus serve to produce plate-shaped part 8, as it is represented in FIG. 1, i.e., without a running surface coating. Molded part 16 exhibits elevations 19, which subsequently serve for the placement of steel edges.

Figure 5:
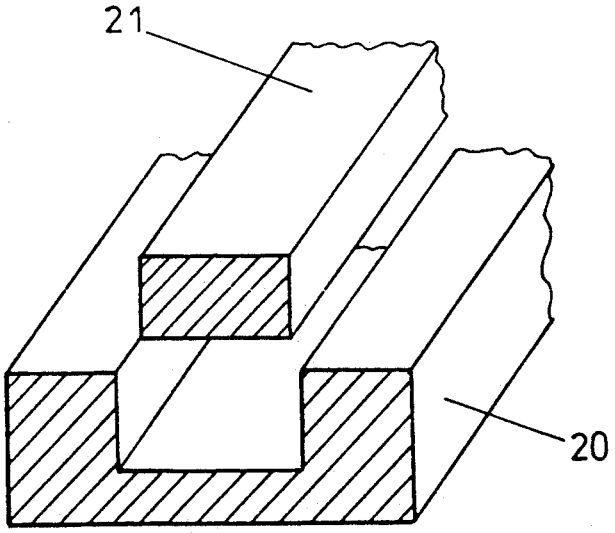
FIG. 5 is a representation similar to FIG. 4 of molded parts for the production of the U sections.

Molded parts 20 and 21 for producing a U section for the formation of the body of the ski are represented in FIG. 5, and for the design of U sections 2 of FIGS. 1 and 2 that exhibit a constant width, a constant mold can be provided independently of the final form of the ski. Only middle U section 4 represented in FIGS. 1 and 2 exhibits a varying width over its length for the adjustment of a desired shaping of a ski.

Besides the use of sections exhibiting at least a partially uniform form and a simple production of a basically plate-shaped part for connection to the webs of the U sections, the height, which generally varies over the length of the ski, can be adjusted simply by milling the height contour of the U sections.

Figure 6:
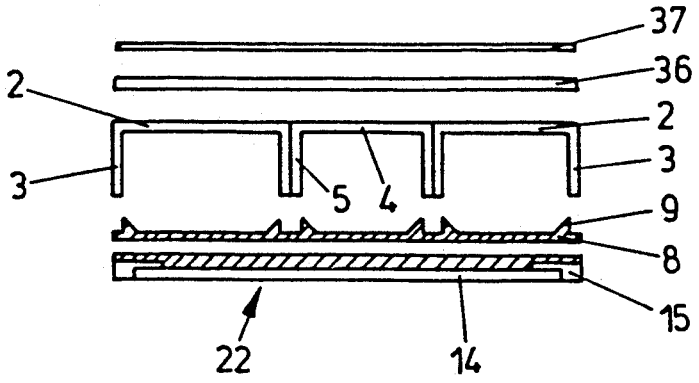
FIG. 6 is a section through a modified embodiment of a ski according to the invention, and for the sake of clarity analogously to the representation of FIG. 1, the individual components are represented separate from one another.

The plastic shell ski represented in FIG. 6 is in turn designed from three U sections 2 and 4 open to the same side, and webs 3 or 5 of the U sections are in turn connected to plate-shaped part 8 which exhibits connecting sections 9 running in the longitudinal direction of the ski. In this design the plate-shaped part is designed to close U sections 2 or 4 as a separate component and is subsequently connected to lower part 22 which carries running surface 14 and edges 15. Further, upper strap component 36 and in any case a cover layer 37 can be provided.

Figure 7:
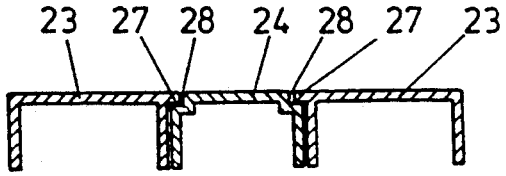
FIG. 7 is a section through a further modified embodiment through the hollow sections forming the core with a tongue and groove connection of the individual sections according to line VII—VII in FIG. 9.
Figure 8:
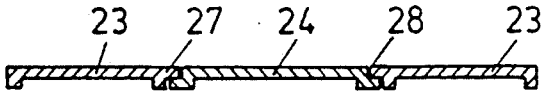
FIG. 8 is a top view analogous to FIG. 7 along line VIII—VIII of FIG. 9.
Figure 9:
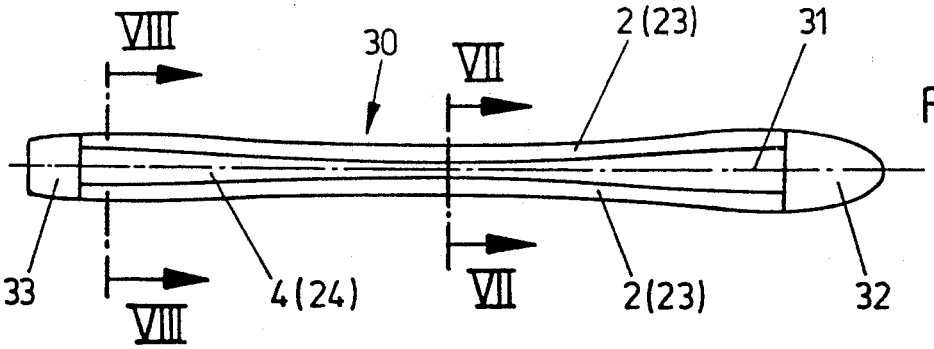
FIG. 9 is a top view of a ski according to the invention according to FIGS. 7 and 8.
Figure 10:
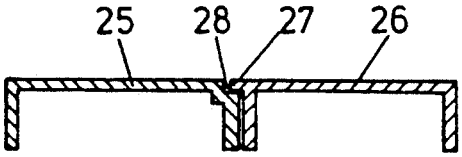
FIG. 10 is an embodiment similar to the embodiment according to FIG. 7, in which only two U sections are used.

In the embodiments represented in FIGS. 7, 8 and 10, U sections 23, 24, 25 and 26 are used, in which on the closed tops either side lugs or projections 27 or recesses 28 are provided, where lugs or projections 27 of each U section positively engage in recesses 28 of the adjacent U section. The webs of U sections 23 through 26, as in the preceding embodiments, are in turn connected to a basically plate-shaped part to form a ski. In FIG. 8 the webs are thus shortened in elevation setting in comparison to the webs in FIG. 7, so that in different areas of the ski a different height is obtained. Further, it is evident that middle section 24 exhibits different widths, to produce the shaping represented in FIG. 9.

In FIG. 9, ski 30 according to the invention is represented in top view, and in the parts adjacent to the side walls run sections 2, which exhibit a basically constant width over the entire length of the ski. To obtain a shaping of the ski at least one inner section 4 is used, whose dimension is designed to be variable crosswise to the ski longitudinal direction over the length of the ski. But instead of such an inner section, the design can be made so that only two outer sections 2 are used, and the inner hollow space limited by sections 2 can be accordingly filled with foam or other material. To form a plane cover surface, the design can also be made in accordance with the embodiment represented in FIG. 10 so that the projection or side lug 27 of section 26 exhibits over the length of the ski a variable dimension in the direction crosswise to the ski longitudinal direction and engages in recess 28 of section 25 and thus covers the hollow space located between the sections. To finish the ski, shovel part or forward tip 32 and a tail part 33 are connected to the basic ski body, as this is explained in greater detail below in the figures that follow.

Figure 11:
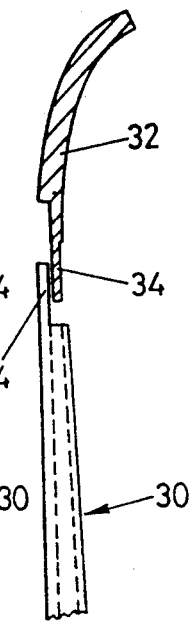
FIG. 11 is a partial top view of a ski according to the invention on enlarged scale as compared to FIG. 9, where the shovels and tail that can be connected to the hollow sections are represented separate from the ski body.
Figure 11:
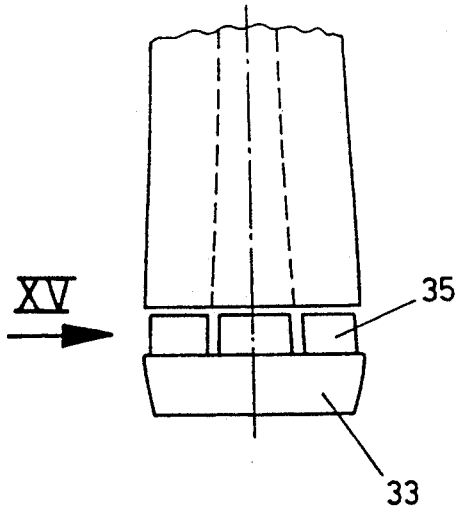

In FIG. 11, shovel 32 and tail area 33 are represented as separate from the basic ski body that is formed of hollow sections and both shovel 32 and tail area 33 exhibit projections or lugs 34 and 35 which can be positively inserted into the diagrammatically indicated sections of the basic ski body and can be connected to them.

Figure 12:
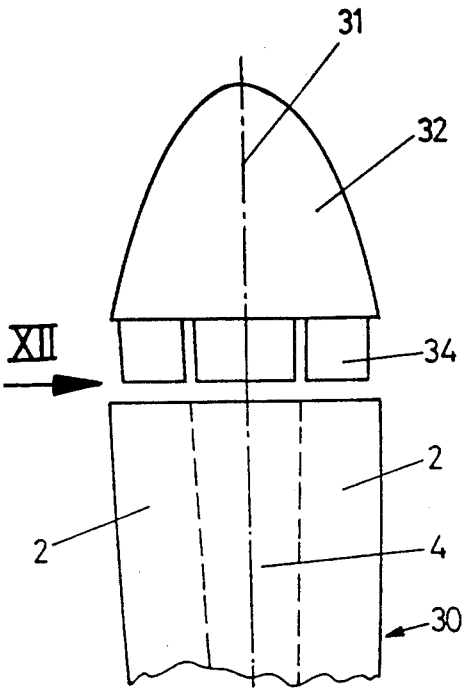
FIGS. 12, 13 and 14 are side views in the direction of arrow XII of FIG. 11 of different embodiments of the connection between the shovel and the ski body.
Figure 13:
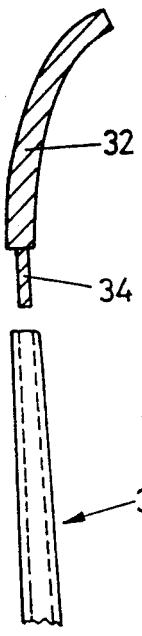
Figure 14:
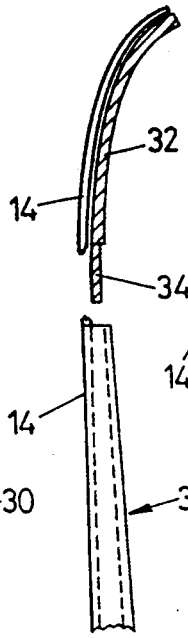

Different embodiments of the projections or lugs of shovel part 32 are represented in side view in FIGS. 12, 13 and 14. A completely formed tip part with firmly connected projections 34 is used in FIG. 12, and the projections sink into the diagrammatically indicated section hollow spaces for a positive connection. In the design according to FIG. 13, running surface strap 14 extending over the entire ski length is used, so that lug 34 on the side facing the running surface locks flush with tip part 32 and subsequently a connection of the tip with the basic ski body takes places by applying running surface strap 14. In FIG. 14 a projection or lug 34 designed offset is used, which interacts with a correspondingly designed running surface area.

Figure 15:
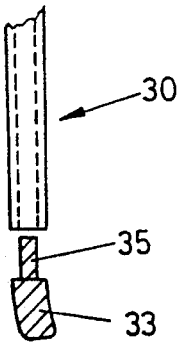
FIG. 15 is a view in the direction of arrow XV of FIG. 11 of a connection of the tail area with the ski body.

Projection 35, illustrated in FIG. 12, is to be positively inserted into the hollow sections of the basic ski body as represented in FIG. 15. Analogously to the embodiments according to FIGS. 13 and 14, projections or lugs 35 of tail area 33 can also be designed for a connection with the basic ski body.

Figure 16:
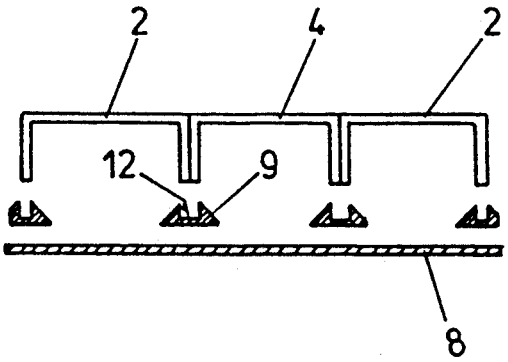
FIG. 16, in a representation similar to FIG. 6, is a modified embodiment in which the connecting sections are designed separate from the plate-shaped part.

In the embodiment represented in FIG. 16, again three U sections 2 and 4 are used, and connecting sections 9 designed separately from plate-shaped part 8 are each provided with longitudinal groove 12, said sections are made of plastic or aluminum and are connected to the plate-shaped part by welding or gluing.

Figure 17:
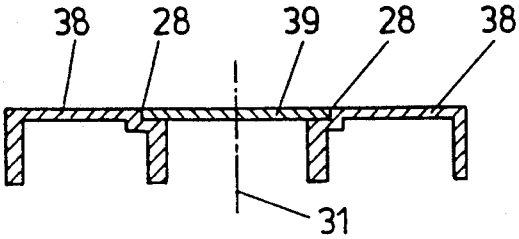
FIG. 17 is an embodiment in which only two U sections are used and the free space remaining between the inner webs of the U sections is covered by a cover plate.

According to FIG. 17, two outside sections 38 designed symmetrical to middle axis 31 of the ski are used, which in the area of their inside web on their top facing away from the plate-shaped part, each exhibit recess 28 to fasten cover plate 39 analogously to the embodiments according to FIGS. 7 and 8. Cover plate 39 here exhibits a varying width over the length of the ski according to the desired shaping of the ski.

Figure 18:
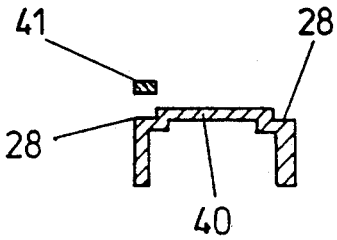
FIG. 18 is a single U section with recesses placed on both sides of its closed top that is facing away from the plate-shaped part to receive a cover plate or top edge.

In FIG. 18, a modified embodiment of section 40 is represented, which exhibits recesses 28 on both sides, and in the inside recess, analogously to the embodiment according to FIG. 17 a cover plate or in accordance with the embodiment according to FIG. 10, a projection or lug 27 can be received and insert edge 41 made of plastic or aluminum and designed according to the desired conditions can be used in the outer recess.

Figure 19:
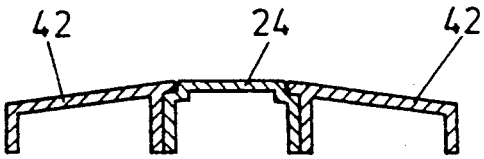
FIG. 19 is a modified embodiment in a representation similar to FIG. 7, in which the outer U sections define a plane inclined toward the running surface.
Figure 20:
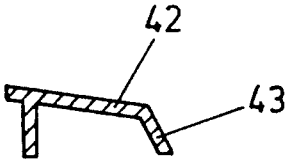
FIG. 20 is an outer U section in a representation similar to FIG. 19, and the outer web runs inclined to the running surface for formation of an inclined side wall.

The design according to FIG. 19 corresponds very largely to the design according to FIGS. 7 and 8, and deviating from these embodiments described in greater detail above, outer U sections 42 are used which exhibit a top inclined toward the running surface plane, so that on the whole a convex surface results. In the design according to FIG. 20, in addition to the inclined top facing away from the plate-shaped part, outer web 43 is designed with an angle deviating from a right angle to the running surface plane, to produce directly inclined side walls.

Figure 21:
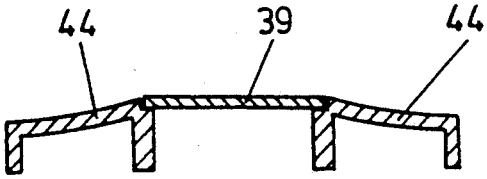
FIG. 21 is a further modified embodiment, and the free space remaining between the outer U sections is in turn covered by a cover plate and the side U sections define a surface that is inclined or curved to the running surface plane.
Figure 22:
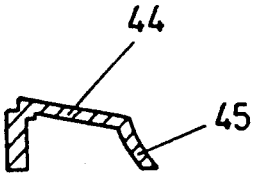
FIG. 22 in a representation similar to FIG. 20 is an outer U section with a web inclined toward the running surface plane.

In the design according to FIG. 21 outside sections 44 exhibit a curved top facing away from the plate-shaped part and the distance that is optionally made variable by a desired shaping between the inside webs of sections 44 is covered by cover plate 39 analogously to the design according to FIG. 17. The embodiment according to FIG. 22 exhibits, analogously to the design according to FIG. 20, an obliquely placed outside web 45 that runs in a curved fashion.

The hollow sections, designed as U sections, forming the body can be produced from thermoplastics, thermosets, plastic composites, aluminum, GRPs or the like and can either be pultruded, extruded, calendered and/or rolled as endless sections. Alternatively piecewise pressing, injection molding or deforming can be done with the molds represented in FIGS. 4 and 5.

As already mentioned, when there are U sections located next to one another, directly following one another or with correspondingly designed tongue and groove connections, the upper strap can be formed basically with the webs or lugs of the U sections, so that to finish the upper area of the ski only a coating with a laminate or simply varnishing must be performed. Alternatively the design can be made, as this is represented for example in FIG. 6, so that an upper strap component made of GRPs, aluminum or other materials is used and is covered with a laminate and/or a laminate with varnishing.

Even separately designed tips and tails can be produced as one part or multipart as a molded, injection molded or pressed part and can be designed as compact or ribbed for reinforcement. Any stability from hard to rubber elastic can be selected.

For the plate-shaped lower part for the connection with the webs of the U sections, generally fiber glass reinforced plastics, thermoplastics, thermosets that can be designed reinforced or unreinforced and aluminum, are used, and either a composite with the running surface and the steel edges or a completely separate design can be provided.

The connection of the individual components, i.e., the U sections comprising the body, with the plate-shaped lower part or with the entire lower strap and also with the upper strap generally takes place through gluing, welding, ultrasound or the like . . .

The spacers formed with the webs are used to adjust the overall height. In addition, in the design of the U sections, carrying the upper strap opposite the open side, is also included in so that only one coating is necessary for design purposes.

We claim:

1. A ski comprising:

a body portion formed by at least three elongated and adjacent U-shaped member including one inside U-shaped member and two outside U-shaped members each having a base portion and a pair of laterally spaced webs extending in a height dimension away from said base portion and in a length dimension along the base portion in a longitudinal direction of the ski; and a substantially planar base plate provided with laterally spaced connecting sections having elongated grooves extending in the longitudinal direction of the ski, including means for securing free ends of said webs within said grooves of said connecting sections;

and further wherein said outside members have substantially constant widths over said length dimension and said inside member has a width which varies over said length dimension.

2. A ski comprising:

a body portion formed by three separate, elongated U-shaped members, each having a base portion and a pair of laterally spaced webs extending in a height dimension away from said base portion and in a length dimension along the base portion in a longitudinal direction of the ski wherein a pair of outside U-shaped members are located on either side of a remaining inside member, and wherein said outside members have a substantially constant width over said length dimension and said inside member has a width which varies over said length dimension; and a substantially planar base plate provided with laterally spaced, elongated grooves extending in the longitudinal direction of the ski, said grooves having a depth substantially less than said height dimension of said webs, and including means for securing free ends of said webs within said grooves.

3. The ski of claim 2 wherein said webs are secured within said grooves by welding.

4. The ski of claim 2 wherein said webs are secured within said grooves by gluing.

5. The ski of claim 2 wherein said grooves are formed in longitudinally extending connecting sections, each connecting section having an external width dimension which increases in a direction toward said base plate.

6. The ski of claim 2 wherein said elongated U-shaped members are arranged in side-by-side, connected relationship, with adjacent webs of adjacent U-shaped members defining a combined thickness equal to twice the thickness of each web individually, and wherein said grooves have a width dimension substantially equal to the thickness defined by the adjacent webs.

7. The ski of claim 5 wherein said connecting sections are constructed of plastic.

8. The ski of claim 5 wherein said connecting sections are constructed of aluminum.

9. The ski of claim 7 wherein said connecting sections are secured to said base plate by gluing.

10. The ski of claim 8 wherein said connecting sections are secured to said base plate by welding.

11. The ski of claim 8 wherein said connecting sections are secured to said base plate by gluing.

12. The ski of claim 2 wherein outermost webs of said pair of outside U-shaped members are inclined relative to remaining webs inside said outermost webs.

13. The ski of claim 2 and further including a cover extending over and secured to said base portion of each of said U-shaped members, and side walls extending over and secured to outermost webs of said at least one pair of webs.

14. The ski of claim 13 wherein said substantially planar base plate has steel edge members secured to an exterior surface of said base plate along longitudinal edges thereof, and wherein said exterior surface is coated with a running surface extending between said steel edges.

15. The ski of claim 2 wherein said three U-shaped members are interconnected at the respective base portions.

16. The ski of claim 2 wherein said substantially planar base plate is covered by a lower part secured to said base plate, said lower part including a running surface and outside edges.

* * * * *